US011073260B2

(12) United States Patent
Cadisch et al.

(10) Patent No.: US 11,073,260 B2
(45) Date of Patent: Jul. 27, 2021

(54) MODULAR LUMINAIRE SUPPORT

(71) Applicants: Simon Cadisch, Hertfordshire (GB); Ecoled Ltd, Hertfordshire (GB)

(72) Inventors: Simon Cadisch, Hertfordshire (GB); David Ong, London (GB)

(73) Assignee: ECOLED LTD., Hertfordshire (GB)

( * ) Notice: Subject to any disclaimer, the term of this patent is extended or adjusted under 35 U.S.C. 154(b) by 0 days.

(21) Appl. No.: 16/452,289

(22) Filed: Jun. 25, 2019

(65) Prior Publication Data

US 2019/0390841 A1 Dec. 26, 2019

(51) Int. Cl.
*F21V 17/00* (2006.01)
*F21V 21/04* (2006.01)

(52) U.S. Cl.
CPC ..... *F21V 17/002* (2013.01); *F21V 21/04* (2013.01)

(58) Field of Classification Search
CPC .. F21S 8/02–028; F21V 17/002; F21V 17/12; F21V 21/04–049; F21V 21/30
USPC ..... 362/232, 239, 249.03–249.05, 362/249.07–249.1, 277, 282–283, 362/285–287, 319, 364–365, 434, 449, 362/455
See application file for complete search history.

(56) References Cited

U.S. PATENT DOCUMENTS

| | | | | |
|---|---|---|---|---|
| 2,179,161 | A | 11/1939 | Rambusch et al. | |
| 6,371,628 | B1 | 4/2002 | Ward | |
| 7,011,439 | B1 * | 3/2006 | Kane | G02B 6/0008 362/269 |
| 2012/0033434 | A1 | 2/2012 | Wang | |
| 2017/0343195 | A1 * | 11/2017 | Cadisch | F21V 21/30 |

FOREIGN PATENT DOCUMENTS

| | | | |
|---|---|---|---|
| BR | PI0505434-6 | A | 9/2007 |
| CN | 202580735 | U | 12/2012 |
| GB | 942630 | | 2/1962 |
| JP | 2001184934 | | 7/2001 |
| JP | 2008235216 | A | 10/2008 |
| JP | 2017050187 | A | 3/2017 |
| KR | 101033977 | B1 | 5/2011 |
| WO | 2016087668 | A1 | 6/2016 |

* cited by examiner

*Primary Examiner* — Jason M Han
(74) *Attorney, Agent, or Firm* — Blue Filament Law PLLC

(57) ABSTRACT

A light fitting for recessed mounting of a luminaire in a substrate includes a luminaire support having a neck portion to support a luminaire and a head portion having a light beam channel for the passage of light from a luminaire through the luminaire support to a mouth and a peripheral insert defining at least a portion of the light beam channel, which facilitates provision of inter-changeable functions and features on the internal surface of the luminaire support and within the light beam channel.

15 Claims, 6 Drawing Sheets

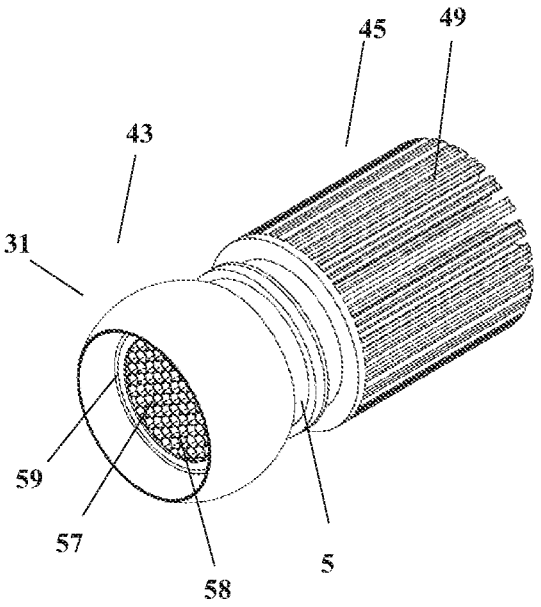
Figure 4A
Figure 4B
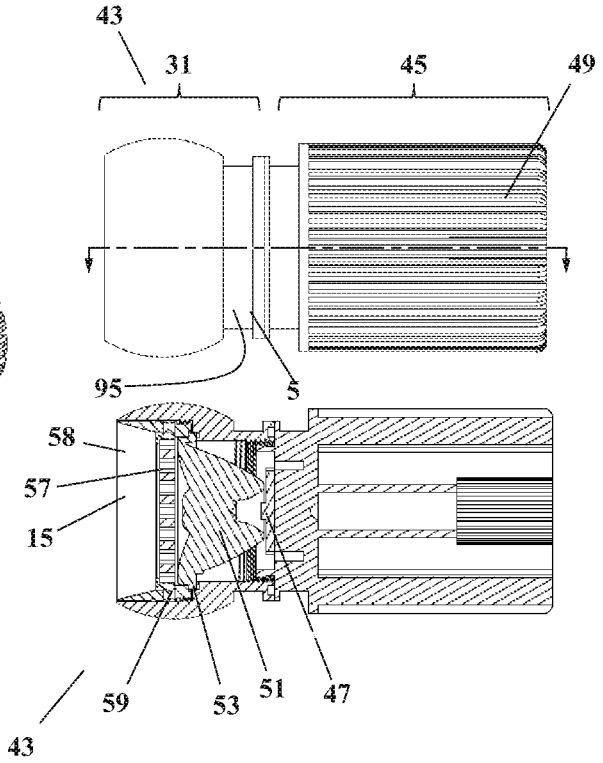
Figure 4C

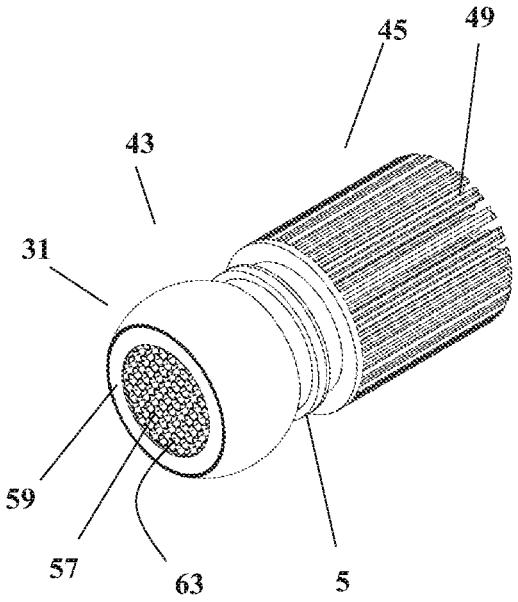
Figure 5A
Figure 5B
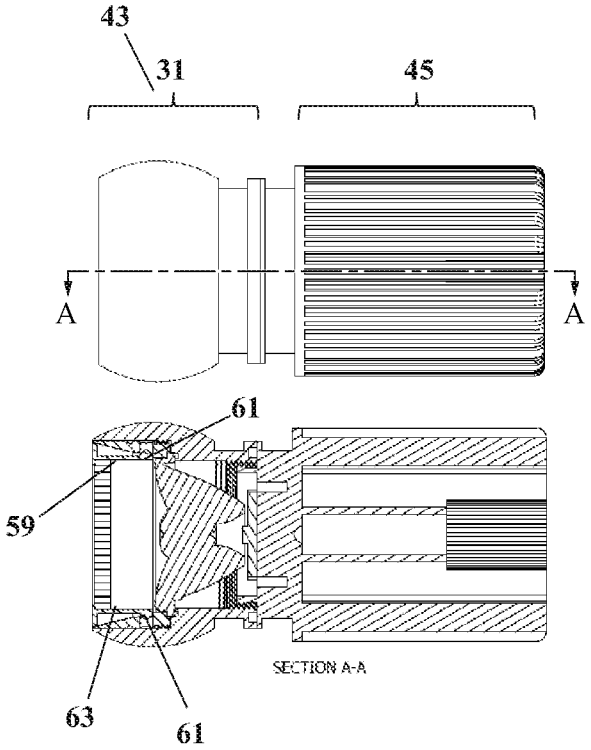
Figure 5C
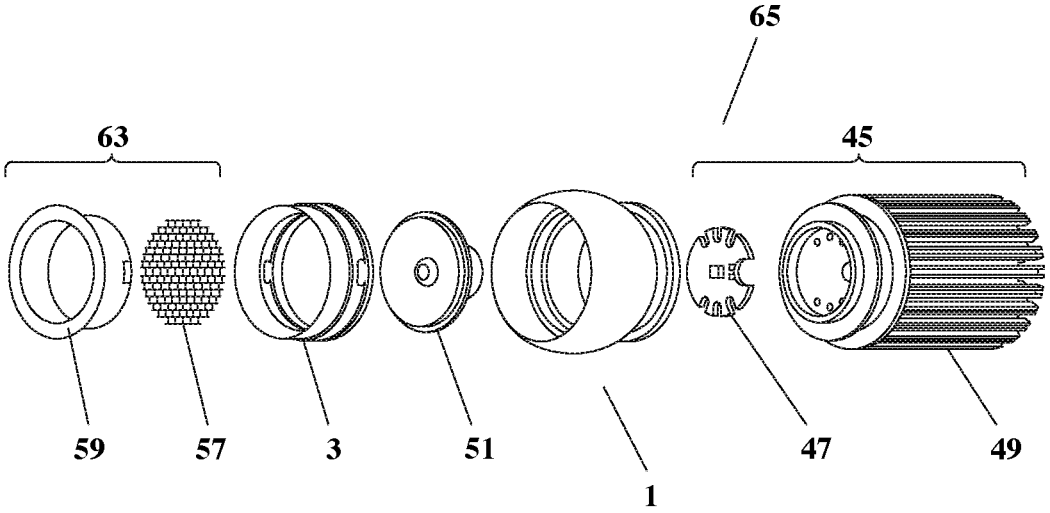
Figure 6

MODULAR LUMINAIRE SUPPORT

FIELD OF THE INVENTION

The present invention relates to light fitting systems and to light fittings for recessed mounting of a luminaire in a substrate which allows a user to manipulate the luminaire or its support in the light fitting, a tool for this purpose and a luminaire support adapted to be adapted or manipulated. More particularly, the invention relates to a luminaire support for use in a light fitting.

BACKGROUND OF THE INVENTION

Lights recessed within walls or ceilings have been popular in the commercial environment for some time. The display industry, in particular in department stores, has made considerable use of recessed light fittings. A single light fitting may be used to project light over a general area or it may be used to project light at a particular object. Recessed light fittings have become popular in other situations, like, for example, the domestic environment. This popularity has gathered pace with advances in technology that have resulted in light-emitting diodes becoming a viable alternative light source to filament lamps. For the sake of brevity, the conventional term "LED" shall be used to describe a light-emitting diode hereon.

US-A-2012/0033434 discloses a light fitting for adjustable recessed mounting of a luminaire in a substrate. The light fitting comprises a base with a substantially semi-spherical cavity defined therein and a casing pivotally disposed in the cavity. The casing is movable relative to the cavity along the semi-spherical shape of the cavity. The casing comprises LEDs for providing illumination through a lens. The light fitting comprises a housing with a cover which protectively shields the base and the casing. The cover has an accommodating hole through which the base partially protrudes. The LEDs may be pivoted to project light at various angles in relation to the general area.

The popularity of recessed light fittings is complemented by a need for economic installment techniques. Whilst the light fitting of US-A-2012/0033434 may have adjustable light projection, the adjustable components are a pre-assembled unit of the base plus the casing including the LEDs which are enclosed within the casing. Renewal, or repair, of the LEDs requires removal of the cover to gain access with the attendant risk that, in the process, the cover may or its fasteners may be damaged or mislaid. Then the base must be unscrewed from the housing. This makes heavy and repetitive work for the user. Maintenance of the light fitting of US2012/0033434 is an inflexible process which takes time and effort.

WO-A-2016/087668 describes a light fitting assembly for a recessed LED light, the assembly having a base and a luminaire support to which the luminaire (comprising an LED and heat sink) may be secured. The base and luminaire support are configured in a socket and ball arrangement, whereby the luminaire has an expanded waist which may be removably received within a corresponding socket portion in the base and retained therein by way of a resilient member in the base. Further, the luminaire support is configured for cooperative inter-engagement with a manipulation tool to facilitate directional adjustment of the luminaire support within the base and removal of the luminaire support from the base via its mouth.

It is an object of the present invention to provide an improved light fitting system.

Problem to be Solved by the Invention

There is a need for improvements in LED light fittings, especially recessed light fittings, to improve access for repair, directional control, optical adjustments, modularity, ease and efficiency of installations and to improve manufacturing processes.

It is an object of this invention to provide a light fitting for a recessed LED light that has improved function and adjustability, including directional control;

It is a further object of this invention to provide a light fitting for recessed LED light that has improved modularity, ease of installation and improved manufacturability;

It is a further object of this invention to provide a tool that improves adjustment and/or removal of a light fitting or part thereof from a recess.

SUMMARY OF THE INVENTION

In accordance with a first aspect of the invention, there is provided a light fitting for recessed mounting of a luminaire in a substrate, the light fitting comprising a luminaire support, which luminaire support has a neck portion to support a luminaire or parts thereof and a head portion having a light beam channel for the passage of light from a luminaire through the luminaire support to a mouth, the light beam channel defined by an internal surface of the head portion, wherein the luminaire support comprises a luminaire support body and a peripheral insert, preferably an annular insert, wherein the peripheral insert defines at least a portion of the light beam channel.

In a second aspect of the invention, there is provided a luminaire support having a neck portion to support a luminaire or parts thereof and a head portion having a light beam channel for the passage of light from a luminaire through the luminaire support to a mouth, the light beam channel defined by an internal surface of the head portion, wherein the luminaire support comprises a luminaire body and a peripheral insert, preferably an annular insert, wherein the peripheral insert defines at least a portion of the light beam channel.

In a third aspect of the invention, there is provided a peripheral insert, preferably an annular insert, for use in the light fitting above.

In a fourth aspect of the invention, there is provided an optical accessory for disposing in a light beam channel of a luminaire support, preferably a head portion of the luminaire support, the optical accessory comprising a transverse member for disposing transversely across the light beam channel and a longitudinal member configured to releasably cooperate with the luminaire support, such as the internal surface thereof.

In a fifth aspect of the invention, there is provided a method for the manufacture of a light fitting as defined above, the method comprises forming a luminaire support body having a neck portion to support a luminaire or parts thereof and a head portion having an interior channel disposed therein, treating or coating an external surface of the luminaire support body, forming a peripheral insert, preferably an annular insert, optionally disposing an optical element in the luminaire support body to abut a receiving seat, and inserting the peripheral insert into the channel of the luminaire support body to engage therewith to define at least a portion of a light beam channel for the passage of light from a luminaire through the luminaire support to a mouth.

In a sixth aspect of the invention, there is provided a modular light fitting comprising:

a luminaire support;

a base having an outer aperture for removably receiving the luminaire support via the outer aperture, wherein the luminaire support comprises a mouth disposed to an outer end thereof and comprises at least one optical component which is removably receivable in the luminaire support via the mouth of the luminaire support.

In a seventh aspect, there is provided a modular luminaire or luminaire support, wherein the luminaire or luminaire support comprises a mouth disposed to an outer end thereof and comprises at least one optical component, which is removably receivable in the luminaire or luminaire support via the mouth of the luminaire or luminaire support.

In an eighth aspect of the invention there is provided a light fitting system comprising a light fitting for recessed mounting of a luminaire in a substrate, the light fitting comprising a luminaire support and a base for receiving the luminaire support and a luminaire support tool for manipulating the luminaire support in relation to the base of the light fitting, wherein luminaire support defines a light beam channel for the passage of light from an associated luminaire, the light beam channel defining a first longitudinal axis, wherein the luminaire support tool has an elongate handle member defining a second longitudinal axis and which is adapted at a first or proximal end to engage with the luminaire support so as to facilitate its manipulation and which when engaged with the luminaire support disposes the second longitudinal axis substantially parallel with the first longitudinal axis and wherein a second or distal end of the elongate handle member has a light source configured to project a directional beam which directional beam is substantially parallel with the second longitudinal axis, whereby the directional beam projected by the second light source during manipulation of the luminaire by the tool is indicative (to a user) of the angle of projection of a light beam from an associated luminaire at the adjusted position of the luminaire support.

In a ninth aspect of the invention, there is provided a luminaire support tool for use in the above system.

In an tenth aspect of the invention, there is provided a luminaire support tool for manipulating a luminaire support in relation to a base of a light fitting, the luminaire support tool comprising an elongate handle having a longitudinal axis and being configured at a first or proximal end thereof with engagement means to engage a luminaire support of a light fitting and wherein the luminaire support tool comprises at a second or distal end thereof a light source configured to project a directional beam which directional beam is substantially parallel with the longitudinal axis.

In an eleventh aspect of the invention, there is provided a method of manipulating a luminaire support, the method comprises providing a luminaire support as defined above having a light beam channel defined by an internal surface of the luminaire support which luminaire support enables engagement by a luminaire support tool (e.g. by having one or more recess formed in the internal surface, which recess is configured to receive a corresponding protrusion); providing a luminaire support tool as defined above preferably having one or more laterally extending protrusion for inter-engagement with a recess of the luminaire support; causing the tool to adopt a disengaged configuration (e.g. a second, released configuration in which its one or more protrusions are retracted); positioning the tool in relation to the luminaire support for engagement (e.g. passing the first or proximal end of the tool having an engagement means via a mouth of the luminaire support into a light beam channel defined by an internal surface of the luminaire support to a position whereby the retracted protrusion(s) are aligned with the corresponding one or more recess of the luminaire support); causing the tool to adopt a first engaged configuration in which the engagement means engages with the luminaire support (e.g. in which the protrusions extend into to inter-engage with the one or more recess of the luminaire support); whilst in engagement, manipulating the tool in order to correspondingly manipulate the luminaire support by changing the angle at which it is disposed relative to the base to a desired angle which may be determined by observation of the directional beam emanating from the lights source in the second or distal end of the luminaire support tool whilst the tool is engaged with the luminaire support.

Advantages of the Invention

The light fitting of the invention facilitates provision of inter-changeable inserts to provide functions and facilitates improved manufacturing processing.

BRIEF DESCRIPTION OF THE DRAWINGS

FIGS. 4A, 4B and 4C illustrate in front perspective view, side view and cross-sectional view a light fitting according to one embodiment of the invention;

FIGS. 5A, 5B and 5C illustrate in front perspective view, side view and cross-sectional view a light fitting according to another embodiment of the invention;

FIG. 6 illustrates in exploded view a light fitting system according to an embodiment of another aspect of the invention;

DETAILED DESCRIPTION OF THE INVENTION

Figure 1A:
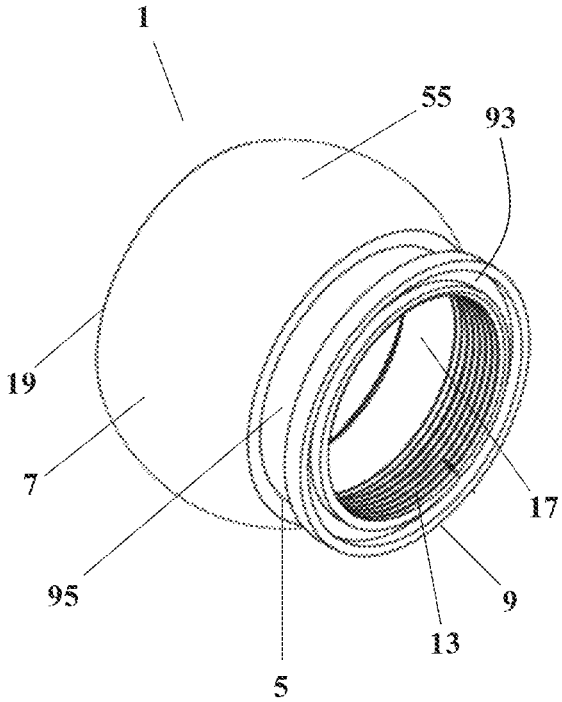
FIGS. 1A and 1B are rear and front perspective views of a luminaire support body for use in a light fitting in accordance with one embodiment of the invention.

The invention in one or more aspects provides a modular light fitting and modular luminaire or luminaire support, which provides insertion and removal of components or optical components in a luminaire support via the mouth or outer end, such components including, for example, an optical element (e.g. a lens), an optical accessory and an insert.

Such components may be inserted and removed via a mouth or outer end of a luminaire support or luminaire support body, while preferably the luminaire support body may be inserted and removed via a mouth or outer opening of a base. Optionally each of one or more optical components that are removably receivable within a luminaire support, via a mouth of the luminaire support may be inserted or removed (and optionally adjusted) by hand or use of a tool (e.g. a manually operable tool). The one or more optical components are preferably independently releasably mounted within the luminaire support by any suitable means. Optionally, two or more optical components may be configured interoperably so that one or more such optical components may depend on one or more other such optical components for removable retention within the luminaire support and, for example, may not be configured with an independent means for mounting within the luminaire support. The one or more optical components may, for example, be independently mountable within the luminaire support by a screw thread, snap-fit, friction fit or resilient retention fit by cooperation with a resilient member (such as an o-ring of rubber or the like), or a magnet. When a luminaire is part of or fitted to a luminaire support, it may preferably be inserted or removed from the base via the mouth or outer opening of the base. Thus, access, interchangeability and modularity in a light fitting are provided.

Aspects and embodiments of the light fitting, luminaire, modular system and components are described hereinafter.

Reference is made to light fittings and components thereof in terms of their position and in particular to interior and exterior (e.g. surfaces of bodies) and inner and outer (e.g. location of components in a light fitting). By interior and exterior it is meant inside or on the inside surface of a respective defined body or outside or on the outside surface of a respective defined body. The terms interior and exterior will typically relate to lateral variations (e.g. laterally outside the body), being lateral to the beam from a luminaire or, for a light fitting which has a longitudinal axis corresponding to its ordinary luminaire beam direction, lateral to the longitudinal axis. The terms inner and outer are used, generally, to refer to a position along the light fitting or a longitudinal axis thereof, such that an inner location or inner direction is considered to be toward the luminaire or light source (or where the luminaire or light source will be relative to the component when in use) whilst an outer location or outer direction is considered to be away from the luminaire or light source or in other words in the direction of the light beam.

Where reference is made to luminaire it may be considered to comprise the LED (or chip) and a heatsink arrangement or, where it is apparent from the context the combination of (or an integrated) luminaire support, LED and heatsink.

Several aspects and embodiments are described herein. Where a particular embodiment or feature is described in relation to one aspect or one embodiment, it should be considered as being applicable and disclosed individually and in relation to other aspects or other corresponding embodiments where the context allows.

The invention relates in one aspect (and one embodiment) to a light fitting, which is for recessed mounting of a luminaire in a substrate, and which comprises a luminaire support having a neck portion to support a luminaire or parts thereof and a head portion having a light beam channel for the passage of light from a luminaire through the luminaire support to a mouth. The light beam channel is defined by an internal surface of the head portion of the luminaire support. The luminaire support comprises a luminaire support body and peripheral insert (which typically and preferably is an annular insert, since the light beam channel is typically and preferably of circular cross section), wherein the peripheral insert defines at least a portion of the light beam channel. In another aspect, the invention relates to the luminaire support that may be used in the above light fitting. And in a further aspect, the invention relates to a peripheral insert for use in the luminaire support.

The peripheral insert may be of any suitable shape. It should preferably have an external surface shape to generally cooperate with a luminaire support body into which it is inserted and an internal surface shape according to the desired shape of the light beam channel which the peripheral insert forms.

The insert is preferably removably mountable within the luminaire support body. Thus, an insert may be substituted or changed, for example to facilitate a different optical effect (e.g. a reflective internal surface as opposed to a matt surface) or textured effect, or simply a different finish (e.g. a white finish as opposed to a black finish). The insert may also have a defined internal surface shape whereby the insert may be substituted to provide different internal surface shapes.

Preferably, in any case, the peripheral insert is an annular insert for being disposed in relation to a cylindrical internal surface of a luminaire support body. The peripheral insert may be referred to as peripheral or annular but features thereof are considered to be generally applicable where the context allows.

It is preferred that the annular insert is removably mountable within the luminaire support body. The annular insert may be mounted or fitted by any suitable means, e.g. a slide or friction fit or a snap fit. Preferably, the annular insert is removably mountable within the luminaire support body by way of cooperating threads on an external surface of the annular insert and an internal surface of the luminaire support body.

The annular insert may be disposed at any location within the light beam channel and cooperate with an internal surface of the housing at any location therein so as to define any portion of the light beam channel. For example, the insert and housing may be configured for disposal of the insert deep within the housing/light beam channel (distal to the mouth), e.g. toward a throat portion, or at a shallow position (proximal to the mouth) or in between. The annular insert may extend longitudinally by a more or less amount as desired. For example, it may extend a major portion of the length of the channel in which it is disposed (and the surface of which it may partially form), such as from 60 to 90% of the length or 70 to 80%, or a minor portion of the length, such as from 15 to 40% of the length or 20 to 30%.

In a preferred embodiment, the annular insert is disposed so as to extend toward the inner portion of the light beam channel from the mouth and, in particular, from the rim of the mouth. Preferably, the annular insert is configured to cooperate with the luminaire support housing to form an edge or rim together with the luminaire support housing defining a rim of the mouth. Preferably, a neat fit is achieved whereby, at or near (e.g. within 2 mm of) the rim, the luminaire support housing and annular insert are separated by no more than 2 mm, more preferably no more than 1 mm, still more preferably no more than 0.5 mm and still more preferably no more than 0.2 mm. Alternatively, the annular insert comprises a flange or lip which extends laterally from one end of the annular insert and is configured to extend over or engage a rim of the housing, e.g. a flange or lip having a lateral extent of up to 2 mm, more preferably, up to 1 mm and optionally from 0.2 to 0.8 mm.

In a preferred embodiment, the annular insert is generally tubular in shape. The annular insert preferably has a cooperating means at an end thereof distal to the mouth, as defined in situ, for cooperating with a tool for inserting or removing the insert.

The luminaire support preferably comprises a mount for receiving or supporting an optical element, such as a lens. The optical mount is preferably disposed in a throat portion of the luminaire support. The optical mount preferably comprises a seat upon which the optical element may rest and a corresponding recess for receiving the optical element.

The optical element or lens may be fixed within the luminaire support at the mount, but is preferably removable, so that a lens of a different effect can be inserted in place thus allowing for considerable adaptability of the luminaire support. Preferably, the lens is removable via the mouth of the luminaire support housing.

In a particularly preferred embodiment, the annular insert serves to retain the optical element in position in the optical mount, whereby the optical element may be removed by first removing the annular insert from the luminaire support body. For example, in one embodiment, the optical element or lens may have an annular flange configured to rest upon a seat disposed in the throat of the luminaire support and thereby configured to extend into a recess defined by the seat and the annular insert (when it is disposed in the luminaire support housing) and wherein the lens is retained in position in the luminaire support until the annular insert is removed. A distal edge (i.e. distal from the mouth of the luminaire support) of a tubular annular insert defines, according to this example, together with the seat, the recess into which an annular flange or annular flange member may extend and rest and be retained. Thus, the lens may be removable and exchangeable and replaceable in the luminaire support by first removing the annular insert.

Preferably, the annular insert defines at least a portion of the internal surface of the luminaire support extending from the optical mount to the mouth. For example, the annular insert may define from 5% to 100% of the extent of the internal surface of the luminaire support from the optical mount to the mouth, e.g. at least 75% of the extent. For example, it may extend to either or both of the rim of the mouth to the seat of the optical mount. For example, it may extend from 5% to 100%, preferably at least 50%, more preferably at least 75%, still more preferably at least 85%, still more preferably at least 90% and most preferably at least 90%.

Preferably, the annular insert extends from the mouth of the luminaire support to the optical mount, or substantially to the optical mount (e.g. separated by an amount to allow a recess for receiving an annular flange of an optical element, such as up to 5 mm, preferably from 1 to 3 mm) or, where an optical element is in position, to an optical element. According to this preferred embodiment, the annular insert may define the light beam channel from the lens to the mouth.

Preferably, the annular insert is secured in the housing by a cooperating thread arrangement, which may optionally be configured to be at the proximal end of the insert to the mouth or the distal end of the insert to the mouth and preferably is at the distal end of the insert from the mouth.

In one embodiment, the peripheral insert comprises engaging features for facilitating or enabling cooperative inter-engagement with a corresponding engaging means of a manipulating tool or with another optical component (which for example, may be attachable or insertable into the luminaire support via the mouth). The engaging features may be recesses or protrusions.

In one embodiment, the peripheral insert defines an engaging recess for receiving a protrusion in a cooperating tool or other optical component. Preferably, the engaging recess, and more preferably at least two engaging recesses are provided to enable a user to engage a tool into the recesses so as to remove the insert from the luminaire support housing, for example by pulling it out (in the case of a snap or friction fit) or by twisting and unthreading (in the cases of a cooperating threaded fit). The recesses may be defined entirely within the body of the insert so as to form two or more apertures for receiving an engaging element (either from a cooperating tool or other optical component). The apertures may be disposed at any position along the length of the insert as may be desired but are preferably provided in a distal portion relative to the mouth of the luminaire support, so as to minimize visual impact, preferably in the distal third of the insert, more preferably the distal quarter of the insert and still more preferably in the distal 10% of the insert. Optionally, as an alternative to apertures, the engaging recesses in the insert may be formed by notches formed in a distal edge of the insert.

Preferably, engaging recesses have an elongate extent or length that is circumferential (e.g. perpendicular to a longitudinal axis of the light beam channel). Preferably, the width may be up to 10 mm, preferably up to 7 mm, e.g. at least 1 mm and preferably from 2.5 to 5 mm. The length of the engaging recesses may preferably be at least 3 mm, e.g. from 5 mm to 10 mm or longer and preferably the engaging recesses are circumferentially separated from one another by at least 2 mm, more preferably at least 5 mm and still more preferably at least 10 mm. There may be any number of engaging recesses as may be required for different functions or for a single function. Preferably there are two engaging recesses disposed radially opposing one another on an annular insert.

The light fitting and system according to the invention and embodiments thereof preferably comprises an optical accessory (which itself is a further aspect of invention). The optical accessory may be any further accessory to a light fitting that affects the light beam, e.g. introduces a change to the nature of the light beam, such as its beam angle, wavelength range, incident pattern or the like. It may be, for example, a filter or a honeycomb device. Preferably, the optical accessory has a light adapting element (such as a honeycomb grid or honeycomb patterned transparent element) and an accessory body for supporting or housing the adapting element. In a preferred embodiment, the accessory body and indeed the optical accessory is adapted to removably attach to the luminaire support via the mouth of the luminaire support. Optionally, the optical accessory may be retained in place by way of the peripheral insert whereby the optical accessory may only be installed or removed by first removing the peripheral insert. Alternatively, and preferably, the optical accessory may be removably attached to the luminaire support via the mouth when the peripheral insert is in place, i.e. through the mouth of the peripheral insert. In either case, the optical accessory may be adapted to attach to either or both (e.g. in a recess defined by both) of the peripheral insert and the luminaire support housing. Preferably, the optical accessory may be attached to the luminaire support via engagement with the peripheral insert, such as via engaging features on or associated with the insert, which are preferably recesses or apertures defined therein and preferably these are releasably engaged (e.g. by push-pull fit arrangement) with resilient laterally or outwardly extending tabs disposed on the accessory body. The accessory body is preferably configured to slot into the light beam channel and the peripheral insert. Preferably, the accessory body is generally tubular and defines an accessory longitudinal axis, which when the optical accessory is disposed in a luminaire support with the peripheral insert is generally coaxial with the peripheral insert and the light beam channel. The optical accessory may be configured so that the adapting element is disposed inside the light beam channel or extends out of the light beam channel (e.g. out of the mouth) or is disposed outside the light beam channel, but preferably is disposed within the light beam channel. If disposed in the light beam channel, the optical accessory may be configured to provide the adapting element at the mouth of the luminaire support (e.g. flush with the rim of the mouth) or at an inner position (at a depth) within the light beam channel, such as relatively closer to a lens (or the throat of the luminaire support), such as adjacent thereto. In either case, the accessory body may have a tubular shape which extends from the mouth of the luminaire support into the light beam channel, which accessory body optionally has an internal surface which may define at least part of the light beam channel when in situ.

A luminaire support may have fitted thereto or integral therewith a luminaire (or LED or chip and heat sink). The luminaire (or luminaire attachment) is preferably configured with the luminaire support to be removable attached to the luminaire support at the neck from the rear of the luminaire support. As such, a replacement LED can be fitted by removing the luminaire support (with attached luminaire) from the mouth of the base, unscrewing the luminaire attachment and re-fitting a new or refurbished luminaire attachment (e.g. with replacement LED) to the neck of the luminaire support.

Preferably, the light fitting is configured such that the luminaire support (optionally carrying as a separable or integral part a luminaire component) may be manipulated relative to the base. The manipulation of the luminaire support relative to the base may comprise one or more of fitting, removing or adjusting the luminaire in relation to the base. Thus, the system may be configured such that the luminaire support may be fitted (or is insertable into) and is removable from the base and/or may be adjusted by manipulation when installed or fitted in the base to different orientations relative to the base (so as to enable a light beam to be provided at different or a variety of orientations or directions).

Preferably, in the light fitting and light fitting system, the base and luminaire support are configured such that the base may removably receive the luminaire support and/or enable angular adjustment of the luminaire support within the base. As such, the light fitting preferably comprises a base having a socket portion for removably receiving the luminaire support and wherein the luminaire support (with an optional tool) are configured to enable fitting and/or removal of the luminaire support into or from the socket portion of the base. Preferably, the base comprises a base collar defining the socket portion and having an outer opening or mouth and wherein the luminaire support may be fitted and removed from the socket portion via the mouth.

Preferably, the light beam channel is defined by the internal surface of the luminaire support and is preferably a hollow central channel, longitudinally disposed in the luminaire. The light beam channel is preferably configured to receive passage of a manipulating tool via the mouth of the luminaire support. The recesses, such as those referred to above as formed in the annular insert, are preferably laterally disposed an preferably extend from the light beam channel. Thus, any cooperating protrusions may extend into the recesses from a tool or other optical component disposed in the light beam channel.

Preferred embodiments of the light fitting and system of the invention offer the particular advantage of a readily adaptable or manipulable luminaire support and where so configured angularly adjustable or removable by means of a luminaire support tool. In combination with the aspects below, the light fitting system enables adjustment and/or removal and replacement of a luminaire from a base without dismantling the fitting from the substrate into which it is fixed. Thus, access to replace a luminaire or to access the electrical wires or other electronics from behind the luminaire may be facilitated without dismantling or removing the base or part thereof and thus without disturbing or damaging a substrate into which it may be mounted.

In a light fitting of a preferred embodiment, for recessed mounting of a luminaire in a substrate, the light fitting comprising: a luminaire support having an expanded waist portion; and a base having a socket portion arranged to receive the waist portion, wherein angular orientation of luminaire support in relation to the base is adjustable by way of relative movement between the socket portion and the waist portion and wherein at least one of the socket portion or waist portion has a resilient member arranged to releasably retain the waist portion in the socket portion.

The light fitting of an embodiment of the present invention permits adjustment of the angular orientation of luminaire support in relation to the base. This allows the light projected from the luminaire to be adjusted to a range of locations and user preferences. Advantageously, a resilient member permits easy and quick release of the luminaire support from the base. Release of the luminaire support from the base according to this embodiment is possible by manipulation of the luminaire support, with or without the assistance of a tool. Advantageously, release of the luminaire support from the base is also reversible because the resilient member automatically recovers its original form. Thus, the resilient member permits quick and easy recoupling and retention of the luminaire support to the base. The luminaire support may simply be plugged into, or unplugged from, the base.

These features enable the base to be connected to a substrate, like, for example, a wall or ceiling, without the luminaire support. This reduces the weight of the installation task because only the base may be installed initially. The luminaire support may be coupled, possibly tool-free, to the base later. For example, a batch of bases may be installed and then the luminaire supports are coupled to the bases later when the electrical power supply cables are ready for connection. Alternatively, a luminaire support, equipped with luminaire, may be decoupled and repaired or replaced while the base remains undisturbed. The user can manipulate the electrical power supply cables and connect them to a freestanding luminaire in the luminaire support before the latter is re-coupled to the base. Luminaire supports, each with LED luminaire, may be retro-fitted in place of filament lamps, again without disturbing the base. Once the luminaire support is coupled to the base, angular orientation of luminaire support in relation to the base can be easily adjusted and allow the user to proceed to the next job.

Preferably, the relative movement between the socket portion and the waist portion is supported by an at least partially spherical surface on at least one of the socket portion and the waist portion. The at least partially spherical surface provides a simple means for rotational and/or pivotal adjustment of the luminaire support in relation to the base.

The or each partially spherical surface may circumscribe the socket portion or waist portion. This may assist rotational and/or pivotal adjustment of the orientation of luminaire support in relation to the base around 360 degrees.

Preferably, the at least partially spherical surface is on one of the socket portion or the waist portion and the other of the socket portion or the waist portion comprises a stop arranged to support the at least partially spherical surface between the stop and the resilient member. The stop limits insertion of the luminaire support inside the base. This may help prevent the luminaire support, and the luminaire connected thereto, from receding too far inside a hole in a substrate and being lost.

Preferably, the stop comprises an at least partially annular flange circumscribing the other of the socket portion or the waist portion. The flange may assist rotational and/or pivotal adjustment of the orientation of luminaire support in relation to the base.

Preferably, the flange circumscribes a channel through the base. Electrical power supply cables destined for a luminaire may pass through the base, via the channel. The luminaire support may be coupled to the base simply by pushing it, the luminaire and the power supply cables back up the channel and through the case until the luminaire support abuts the flange. In this arrangement, the stop may resemble an annular flange.

Sometimes, the luminaire support may be urged in the direction of the base. This could occur if, for example, the light fitting was used in a side of a swimming pool with water pressure continually acting upon the luminaire support. Preferably, the light fitting comprises a cushion between the stop and the at least partially spherical surface. This may absorb at least some of the force acting on the luminaire support and reduce friction between the luminaire support and the base. Preferably, the cushion comprises an o-ring. The o-ring may provide support to the at least partially spherical surface while the waist portion moves about the socket portion. The o-ring may also act as a seal between the waist portion and the socket portion.

The resilient member may be any device, like, for example, a body made of inherently resilient material such as rubber or a detent such as a finger or ball biased by a spring. Preferably, the resilient member comprises an o-ring. The o-ring may provide support to movement between the waist portion and the socket portion while also releasably retaining the waist portion in the socket portion. O-rings are readily available and easily serviceable components, should the need arise.

Preferably, the base comprises a collar configured for recessed mounting in a substrate. The collar may provide a hollow, generally cylindrical, shape adapted to brace the light fitting in hole in a substrate while also to receive and support electrical power supply cables, a luminaire and a luminaire support.

The base may comprises an outer flange configured for engagement with a substrate. This helps to prevent the base receding too far within a hole in a substrate. The outer flange may have an array of perforations. The outer flange may be plastered over to help conceal all but light from the light fitting. The perforations help adhesion of the plaster to the outer flange and help key the base into the substrate.

The light fitting may comprises a luminaire connected to the luminaire support. Thus, the light fitting is ready for connection to an electrical power supply and for use. Alternatively, the luminaire support may be integral with the luminaire.

The light fitting as defined above may be manufactured according to a manufacturing method according to a further aspect, which preferably comprises forming a luminaire support body having a neck portion to support a luminaire or parts thereof and a head portion having an interior channel disposed therein, treating or coating an external surface of the luminaire support body, forming a peripheral insert, optionally disposing an optical element in the luminaire support body to abut a receiving seat, and inserting the peripheral insert into the channel of the luminaire support body to engage therewith to define at least a portion of a light beam channel for the passage of light from a luminaire through the luminaire support to a mouth.

As discussed above, in a further aspect of the invention, a light fitting system comprising a light fitting, such as that described above having a base and a luminaire support, and a luminaire support tool for manipulating the base relative to the luminaire support. In still further aspects, there is provided a luminaire support tool and a method for manipulating a luminaire support within a base using the luminaire support tool. These aspects may be applied to the embodiments of the light fitting and optical components useable therewith as described hereinbefore.

According to an aspect and preferred embodiment, the light fitting system comprises a light fitting for recessed mounting of a luminaire in a substrate, the light fitting comprising a luminaire support and a base for receiving the luminaire support and a luminaire support tool for manipulating the luminaire support in relation to the base of the light fitting, wherein the luminaire support defines a light beam channel for the passage of light from an associated luminaire, the light beam channel defining a first longitudinal axis. The luminaire support tool has an elongate handle member defining a second longitudinal axis and is adapted at a first or proximal end to engage with the luminaire support so as to facilitate its manipulation and which when engaged with the luminaire support disposes the second longitudinal axis substantially parallel with the first longitudinal axis. A second or distal end of the elongate handle member has a light source configured to project a directional beam which directional beam is substantially parallel with the second longitudinal axis, whereby the directional beam projected by the second light source during manipulation of the luminaire by the tool is indicative (to a user) of the angle of projection of a light beam from an associated luminaire at the adjusted position of the luminaire support.

A luminaire support tool according to an aspect of the invention is for manipulating a luminaire support in relation to a base of a light fitting and comprising an elongate handle having a longitudinal axis and being configured at a first or proximal end thereof with engagement means to engage a luminaire support of a light fitting and wherein the luminaire support tool comprises at a second or distal end thereof and a light source configured to project a directional beam which directional beam is substantially parallel with the longitudinal axis.

In use, a luminaire support (such as defined above) having a light beam channel defined by an internal surface of the luminaire support is configured for engagement by a luminaire support tool (e.g. by having one or more recess formed in the internal surface, which recess is configured to receive a corresponding protrusion) may be manipulated in terms of directional orientation within a base by inserting a first or proximal end of the tool having an engagement means via a mouth of the luminaire support into the light beam channel to a position whereby engaging features (e.g. respective protrusions and recesses) on the luminaire support and tool and aligned, causing the tool to adopt a first engaged configuration in which the engaging features are engaged (e.g. protrusions on the tool extend into to inter-engage with the one or more recess of the luminaire support) and whilst in engagement, manipulating the tool in order to correspondingly manipulate the luminaire support by changing the angle at which it is disposed relative to the base to a desired angle. The desired angle may be determined by observation of the directional beam emanating from the light source in the second or distal end of the luminaire support tool whilst the tool is engaged with the luminaire support.

The luminaire support tool preferably comprises one or more laterally extending protrusion for inter-engagement with a recess of the luminaire support.

The luminaire support preferably has an elongate handle and a light source having a directional beam that is substantially parallel and preferably coaxial with a light beam channel of a luminaire support to be manipulated. Preferably, the light source is disposed in the handle (e.g. in a second distal end of the handle). The light source may comprise a discrete LED having a power source (e.g. a battery) all within the handle. Preferably, however, the light source is a light directional channel disposed such that, when the tool is engaged with a luminaire support, light from a luminaire if fitted to the luminaire support would emanate or project through the light directional channel. Preferably, the light directional channel of the tool is configured to be parallel and more preferably coaxial with a light beam channel of the luminaire support.

In a preferred embodiment, the tool comprises an elongate handle having at least one, engaged, configuration in which the elongate handle defines a light directional channel therethrough, which light directional channel comprises a transparent opening at each end and is generally a straight channel. The channel may have a cross section of any shape (e.g. circular, oval, star-shaped, square or triangular).

Preferably, the tool, which is preferably configured to pass into the light beam channel of a corresponding luminaire support via the mouth, is a hand tool having a handle comprising an engaged configuration in which the hand tool may be cooperatively inter-engaged with a luminaire support and a disengaged configuration in which the hand tool may not be cooperatively inter-engaged with a luminaire support. In the engaged configuration, the handle preferably defines a light directional channel, which is preferably configured to be parallel and more preferably coaxial with a light beam channel and may allow, when cooperatively inter-engaged with the luminaire support, light passing through the light beam channel to pass into the light directional channel through an opening or aperture at one end of the handle and out the other end of the handle.

Preferably, the tool may be moved between its first and second configuration by a one hand operation.

In a preferred embodiment, the tool comprises an elongate handle portion and disposed on a distal end thereof an operational portion, wherein the operational portion is provided with one or more protrusions and/or recess for inter-engagement with one or more corresponding recesses and/or protrusions disposed on a luminaire support. Preferably, the operational portion is provided with two laterally outwardly extending protrusions.

Optionally, the tool is biased toward either its first or second configuration and then may be actuated to adopt the other configuration.

Preferably, the operational portion comprises two laterally extending protrusions, when in engaged configuration extend laterally beyond the periphery of the handle by at least 1.5 mm and preferably from 2 to 4 or 5 mm.

Preferably, the elongate handle comprises two tool parts or halves each having opposing interior facing surfaces, one or both of which define respective recessed inner surfaces, which interior facing surfaces together form a passage for light. The or each recessed inner surface extends along the length of the tool part or half. The tool parts or halves are preferably mounted together at a pivot mount proximal to the operational portion. The operational portion preferably comprises the two laterally extending protrusions, one disposed on each tool half or part, such that when disengaged, the handle parts are angled away from one another and the laterally extending projections are angled toward one another so as to reduce their effective lateral extent (and thereby be released from engagement with a luminaire support). When in engaged configuration, the two handle parts abut one another so as the internal faces can define a light directional channel and the laterally extending protrusions extend laterally in opposing directions so as to engage with recesses in a corresponding luminaire support.

Whilst the tool halves may optionally be machined, e.g. from aluminium, preferably, in the tool of this aspect, each tool half is formed by moulding in a mould. Preferably, in this and other aspects of the invention, the tool is moulded from a plastic material (such as, for example, acetal, acrylic, polypropylene, polyamide, polyester, polyethylene, polycarbonate or any other suitable material). Preferably, the tool is formed by injection moulding.

Preferably in embodiments of the above aspects of the invention the cooperating tool and luminaire support may inter-engage sufficiently to put the invention into effect and more preferably with an overlap or to an extent of at least 1.5 mm, more preferably at least 2 mm and optionally from 3 mm up to say 5 mm. For example, the recesses may have a depth of from 2 to 5 mm whilst the lateral projections or flange members when in engaged position may extend at least 1.5, more preferably at least 2 mm into the recess. Preferably the cooperating flange members and recesses extend generally perpendicularly from the longitudinal axes of the respective luminaire support and tool.

The tool is configured to fit into the light beam channel with some clearance. The recess, which is preferably disposed in the light beam channel (e.g. in the insert) at or close to its narrowest point (since it tends to flare from inside to out), is preferably formed in or close to the throat where the diameter may be, for example, from 15 to 25 mm, e.g. 28 to 22 mm and most typically about 20 mm, excluding the depth of the recess itself. The tool, in its released configuration, may have several mm clearance each side, e.g. at least 1 mm and up to 3 mm, preferably 1.5 mm to 2 mm.

The invention will now be described in more detail, without limitation, with reference to the accompanying Figures.

Figure 1B:
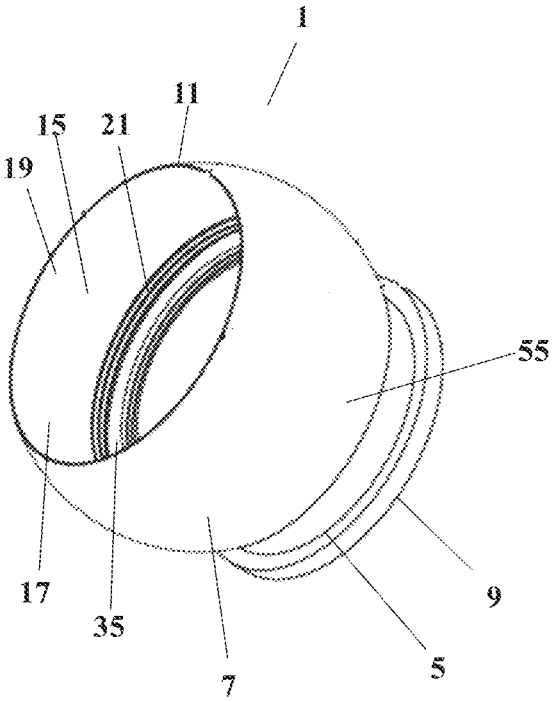
Figure 1C:
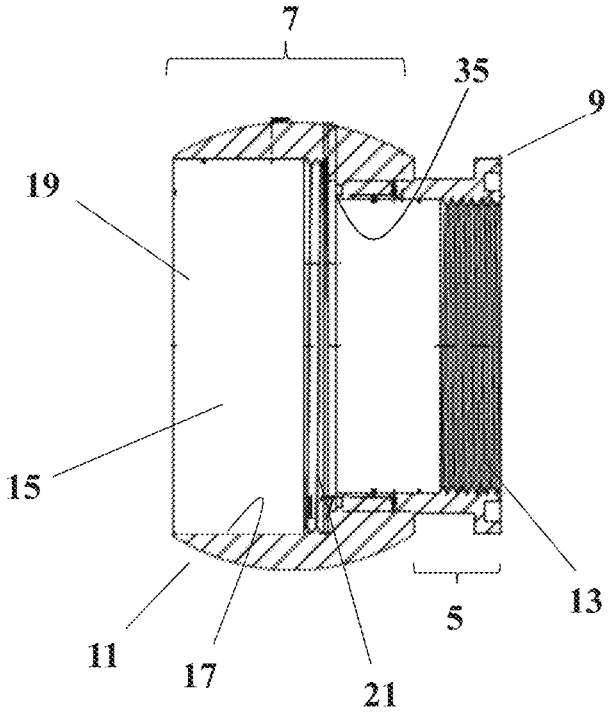
FIG. 1C is a cross-sectional view of the luminaire support body in FIGS. 1A and 1B.
Figure 2A:
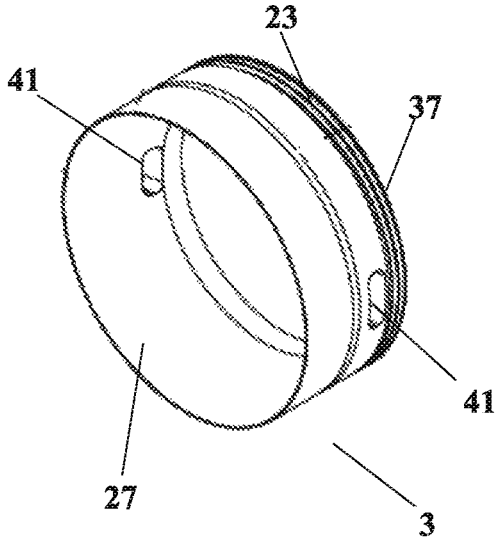
FIG. 2A is a front perspective view of an annular insert for attaching to a luminaire support body of FIGS. 1A and 1B to form a luminaire support and light fitting in accordance with one embodiment of the invention.
Figure 2B:
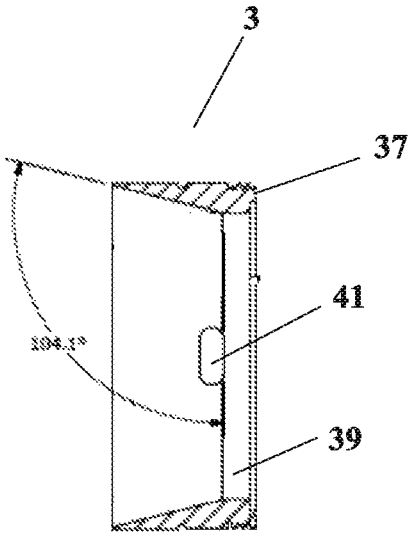
FIG. 2B is a cross-sectional view of the annular insert of FIG. 2A.
Figure 3A:
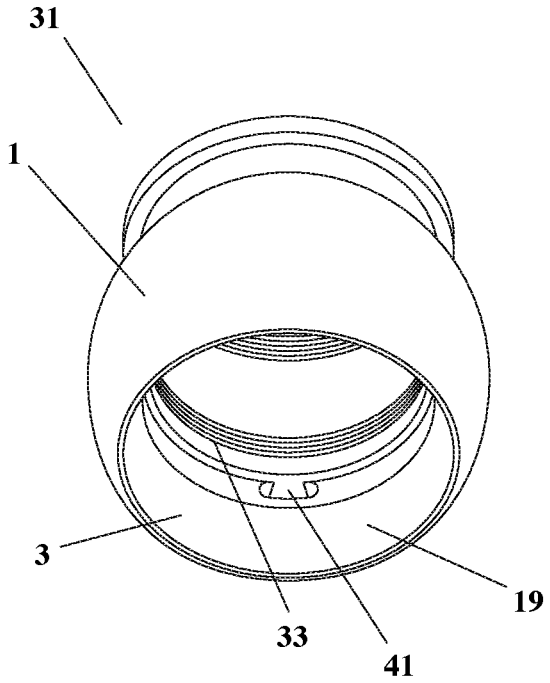
FIG. 3A is a front perspective view of a luminaire support for use in a light fitting according to one embodiment of the invention having a luminaire support body and annular insert of FIGS. 1A, 1B, 1C and 2A and 2B.
Figure 3B:
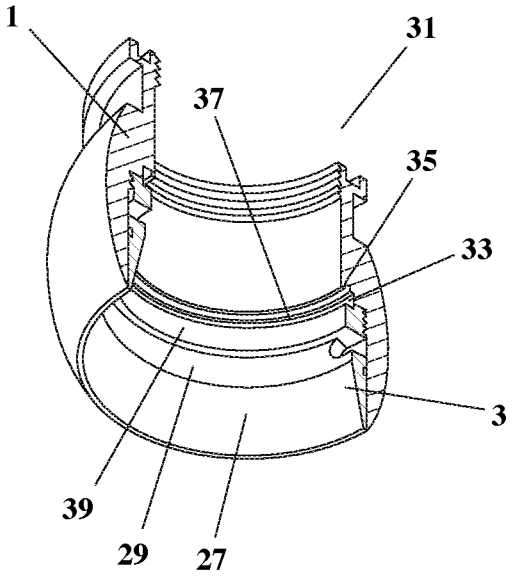
FIG. 3B is a cross-sectional view of the luminaire support of FIG. 3A.

In FIGS. 1A, 1B and 1C is illustrated a luminaire support body 1, in which may be disposed an annular insert 3 shown in FIG. 2 to form a luminaire support of the invention. The luminaire support body 1 has a hollow cylindrical neck 5 disposed toward an inner end 109 of the luminaire support body 1 and to which a luminaire may be mounted by way of luminaire thread 13. The luminaire support body 1 has a head 7 disposed toward the outer end 11 of the luminaire support body 1. A channel 15 extends centrally through the luminaire support body 1 from the inner end 9 and more particularly from the neck 5 through the head 7 to the mouth 19 at the outer end 11 for the passage of a light beam from a luminaire when mounted on the inner end 9 via luminaire thread 13. The light beam channel 15 in the luminaire support body 1 is defined by the body inner surface 17, being the inner surface of the luminaire support body 1. The light beam channel 15 has a longitudinal axis that is central to the luminaire support body 1 in this case and common to the longitudinal axis of the beam from a luminaire when attached to the luminaire support 31. Formed on the body inner surface 17 of the luminaire support body 1 is an insert mounting thread 21 for receiving, via a cooperating insert thread 23 disposed on an outer surface 25 of annular insert 3. The luminaire support body 1 and annular insert 3 are configured so that the annular insert 3 may be fitted and removed from the luminaire support body 1 via the mouth 19 and by threading together or unthreading cooperating threads 21 and 23. Once in position in the luminaire support body 1, insert inner surface 27 defines at least a portion of inner surface 29 defining the light beam channel 15 in luminaire support 31. Thus, insert 3 can be inserted or removed from luminaire support body 1 without disconnecting the luminaire.

When mounted in the luminaire support body 1, the annular insert 3 defines a recess 33 together with lens mount seat 35 in which a lens (not shown) or other optical element may be disposed, extending into the recess 33 and held securely against seat 35 by the inner rim 37 of annular insert 3. The recess 33 and lens mount seat 35 may be considered to be a lens mount. Thus, upon removal of the annular insert 3 from luminaire support body 1, the lens can be removed via mouth 19 without removing the luminaire. So, lenses can be interchanged in luminaire support 31.

Annular insert 3 has an insert inner surface 27 which when in position in luminaire support body 1 defines at least a portion of the inner surface 29 of the luminaire support 31 and in the case illustrated the inner surface 29 extending from the lens mount to the mouth 19.

Annular insert 3 has a cylindrical collar 39 at its inner portion corresponding with the insert thread 23. The annular insert 3 extending from the collar generally tapers outward to a greater diameter to provide an inner surface 29 in the luminaire support 31 which tapers outward to a greater diameter at the mouth from the lens mount.

Disposed in the insert inner surface 27 outward from the collar 39 but proximal thereto are two diametrically opposing apertures 41. The apertures 41 are configured to receive cooperating lateral protrusions on a tool (discussed below) for manipulating the luminaire support 31 and/or the annular insert 3. By inserting a handheld tool having opposing lateral protrusions sized to cooperated with apertures 41 into the light beam channel and actuating the tool so that the lateral projections engage with the apertures 41, the annular insert 3 can be disengaged and removed from (or engaged and inserted into) the luminaire support body 1 by rotating it to unthread it from the insert mounting thread 21.

An external surface 55 of the luminaire support body 1 may be surface treated or surface coated for a particular function or appearance without coating the internal surface 17. The insert internal surface 27 may separately be treated or coated according to preference whereby on insertion of the annular insert 3 into the luminaire support body 1, the resulting luminaire support 31 has a treated or coated external surface and a separately treated or coated internal surface.

FIGS. 4*a*, 4*b* and 4*c* illustrate in perspective, side and cross-sectional views a light fitting 43 comprising a luminaire support 31 and secured to a neck 5 thereof a luminaire 45. The luminaire 45 comprises a light source 47 and a heat sink 49. Disposed in the throat of the luminaire support 31 is a lens 51, which comprises an annular rim 53 abutting lens mount seat 35 and retained in position against the seat 35 and within the luminaire support 31 by inner rim 37 of annular insert 3. Disposed in the light beam channel 15 is a honeycomb optical accessory 57 which comprises a circular accessory rim 59 and disposed across the channel 15 within the rim 59 a honeycomb patterned transparent element 57. Protruding radially outward from the rim 59 are two diametrically opposing and sloping protrusions 61 which have an angle of about than 45° and projects part way into apertures 41 formed in annular insert 3 and thus the internal surface 29 of luminaire support 31, but such that it can be pulled out if required. The element 57 may be removed via the mouth 19.

Similarly, FIGS. 5A, 5B and 5C illustrate perspective, side and cross-sectional views a light fitting 43 comprising a luminaire support 31 and secured to a neck 5 thereof a luminaire 45. Again, in this case, there is disposed in the light beam channel 15 an extended honeycomb optical accessory 63. This extended honeycomb optical accessory 63 has a cylindrical rim 59 which extends longitudinally in a cylindrical form so that a honeycomb patterned transparent element 57, disposed across the channel 15, is provided at one end thereof and longitudinally disposed from the element 57 are the two diametrically opposing and sloping protrusions 61 for fitting into aperture 41. Again optical accessory 63 can be inserted and removed from the mouth 19.

FIG. 6 illustrates an exploded view of a light fitting system 65 comprising a base 67 for mounting into a substrate the base 67 having a hollow collar 69 having an outer opening 71 (see FIG. 7) sized to receive a luminaire support body 1 which is adjustably coupled to the base 67 by way of an adjustable coupling arrangement as between the base 67 and luminaire support body 1. As such the luminaire support body 1 may be coupled to and released from the base 67 via the outer opening 71, which has the advantage that the luminaire support body 1 can be released and removed, with an attached luminaire 45, from the base 67 and from the substrate in order to change or fix the luminaire 45, for example, without disturbing the substrate or removing the base 67. Len 51 may be interchangeable by removing it from the lens mount and seat 35 in the absence of the annular insert 3, the lens 51 being removable via the mouth 19 of the luminaire support body 1. A lens 51 may be secured in place in the luminaire support body 1 against lens mount seat 35 by the annular insert 3 when it is threaded into position within the luminaire support body 1. Annular insert 3 is removably insertable into the luminaire support body 1 as described above via the mouth 19 and securable via cooperating screw threads. An optical accessory 57 such as a honeycomb can be inserted through the mouth of the luminaire support 31 and thus into the annular insert 3 and is securable in position in the luminaire support 31 or annular insert 3 by engagement of two laterally disposed tabs or projections 61 into apertures 41 provided in the annular insert 3. Thus, the optical accessory 57 can be removed or inserted into the luminaire support 31 via the mouth 19. Thus all the components, other than the luminaire element itself which may be secured to the inner end of the luminaire support 31, can be accessed, inserted or removed from the front, either through the outer opening 71 of the base 67 or through the mouth 19 of the luminaire support 31 or both which allows interchangeability and adjustment of components without having to remove the whole light fitting and without disturbing the substrate in which the light fitting is mounted.

Luminaire support tool 71, described in more detail below, may be used to adjust the angle of the luminaire support 31 in the base 67, remove the luminaire support 31 from the base 67 and to disengage the annular insert 3 from the luminaire support 31. All these functions are provided by engagement, in an operational configuration of the luminaire support tool 71, lateral projections 73 on the tool 71 with apertures 41 provided on the annular insert 3, but with different operations. To adjust the angle of the luminaire support 31 in the base 67, the angle of the luminaire support tool 71 is simply adjusted. To remove the luminaire support 31 from the base 67, the luminaire support tool 71 is simply withdrawn or pulled out through the mouth 19 whilst in its operational configuration. To disengage the annular inset 3 from the luminaire support body 1, the tool 71 is simply rotated about the longitudinal axis it defines so as to unscrew the annular insert 3 from the corresponding insert thread on the inner surface of the luminaire support body 1.

As indicated above in relation to FIG. 6, the light fitting of FIG. 6 and all the previous Figures is preferably configured such that the luminaire support 31 may be adjustably coupled to a base 67 by way of an adjustable coupling mechanism. This enables the luminaire support 31 to be coupled and decoupled from the base 67 by manipulation of the luminaire support 31.

Figure 7:
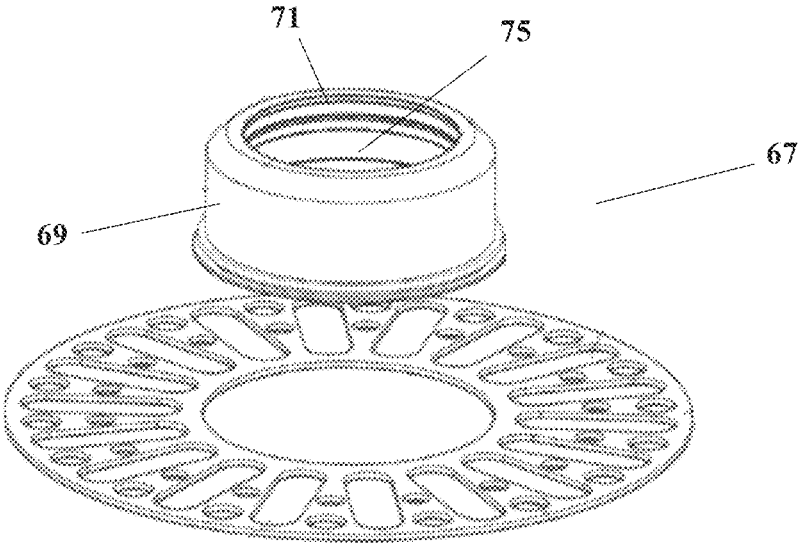
FIG. 7 illustrates a base and associated outer flange for use in a light fitting system of the present invention.
Figure 8:
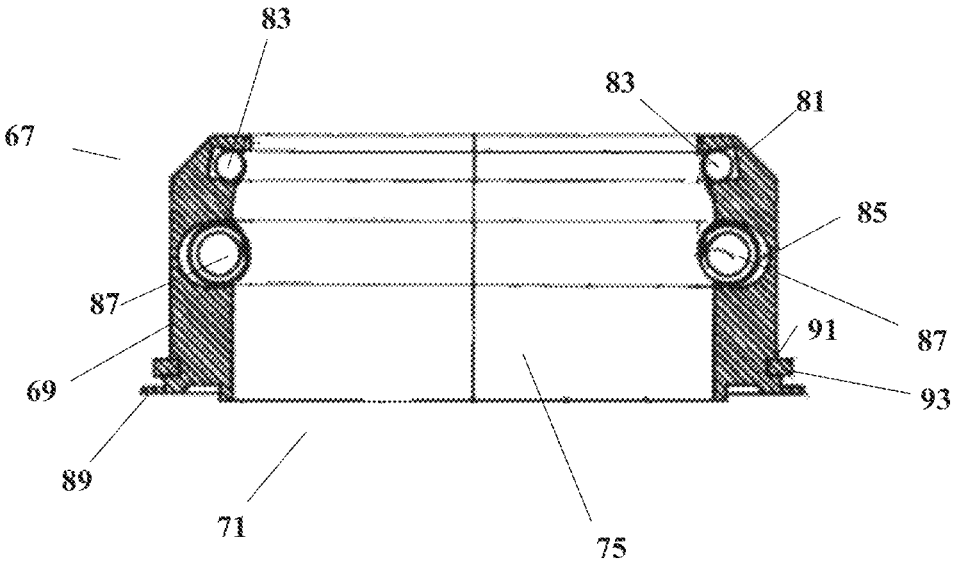
FIG. 8 illustrates a cross-sectional view of a base of the invention.

FIGS. 7 and 8 illustrate the configuration the base 67 in more detail. Base 67 has a base collar 69 defining a hollow central channel 75 extending from an inner flange 77 to the outer opening 71 at the outer end 79 of the base collar 71. Central channel 75 has a small annular groove 81 adjacent the inner flange 77 for receiving an interior small gripping o-ring 83. The small gripping o-ring 83 has a cross-sectional diameter of 3 mm although it could be between about 2 mm and 5 mm. Further, the central channel 75 has large annular groove 85 for receiving an interior large gripping o-ring 87 located approximately midway between the inner flange 77 and the outer opening 71. The large gripping o-ring 87 has a cross-sectional diameter of 6 mm although it could be between about 4 mm and 10 mm, but tends to be about 50% greater than the cross-sectional diameter of the small gripping o-ring 83.

The interior diameter of the outer opening 71 of the base collar 69 in a plane orthogonal to the longitudinal axis is slightly more than the interior diameter of the small o-ring 83 and the interior diameter of the small o-ring 83 is the same or slightly more than the interior diameter of the large o-ring 87. The interior diameter of the central channel 77 tapers gently inwardly from the large o-ring 87 towards the small o-ring 83 but it is always greater then diameter of the outer of the small o-ring 83.

The base collar 71 comprises, around the circumferential exterior of the outer opening mouth 71, an outer annular trim 89 and, nearby, an annular groove 91 for receiving an exterior locking o-ring 93.

The luminaire support 31, as mentioned above comprises a hollow cylindrical neck 5 and an expanded part-spherical head portion 7. The neck 5 and the head 7 have a common central longitudinal axis. The luminaire support 31 may be in line with, and rotated about, the base 67, in which case the longitudinal axis of the central channel 75 of the base 67 and that of the central channel 15 of the luminaire support 31 are co-axial. Alternatively, the luminaire support 31 may be pivoted with respect to the base 67, in which case the axis of the central channel 15 of the luminaire support 31 may be inclined with respect to the axis of the channel 75 of the base 67. The neck 5 and the head 7 portions are integral parts, although, optionally, they made be made of separate parts connected together.

The interior of the neck portion 5, in addition to the luminaire thread 13, has an annular channel 93 for receiving a sealing o-ring which faces the outer end of the luminaire 49 and seals the join between the luminaire 49 and the neck portion 5 when they are engaged. The circumferential exterior of the neck portion 5 has an annular channel 95 for receiving an annular intumescent seal (not shown).

In the case of fire, the intumescent seal expands to fill air gaps between the hole in which it is mounted and the light fitting so that the spread of fire is retarded. The intumescent seal, which is preferably provided by a strip of intumescent tape around a circumference of the luminaire support, is preferably configured such that its (or a coating of intumescent material's) expansion in the event of a fire prevents the luminaire from falling from the base. The luminaire support is held in place by a resilient member, as discussed above, and if the resilient member, softens or becomes pliable (an unlikely event) in a fire, the expansion of the intumescent seal on the luminescent support, ideally on a tail portion thereof, further within the base from a base socket-engaging waist of a luminaire support will prevent the luminaire support from falling from the base. Thus the spread of fire, which would be encouraged by the removal of the luminaire support from the base leaving holes in the ceiling substrate which may otherwise act as vents or chimneys, may be retarded.

The exterior circumference of the head portion 7 has a partially-spherical outer surface 55 has a largest diameter about midway between the neck 5 and the mouth 19. The shape of the partially-spherical outer surface 55 provides a smooth interface between the outer spherical surface and the small 83 and large 87 gripping o-rings and the annular inner flange 77. As the skilled addressee would understand, the partially-spherical outer surface 55 could be incomplete around the waist, if necessary for manufacturing or constructional reasons, and yet this would not prohibit an interface with the small 83 and large 87 gripping o-rings and the annular inner flange 77.

The small o-ring 83, the large o-ring 87, the locking o-ring and the sealing o-ring are all made of a material that is inherently resilient like, for example, rubber.

The luminaire support 31 may be made of any substantially rigid material, provided it is fire retardant, like for example, metal, ceramic, plastic, fibre glass or composite material.

The luminaire 45 comprises a casing, a heat sink 49, control electronics (not shown), an annular web and optical elements like, for example, a light source 47, a lens, a reflector, a diffusion medium and/or a filter to direct and shape light from the light source. The annular web has a threaded exterior for screw-in connection to the luminaire support 31. The light source may be filament lamp or an LED, for example. The light source receives electrical current from an electrical power supply cable (not shown). LEDs have a lower energy consumption, longer lifespan and greater reliability than filament lamps which make LEDs a preferred option of light source.

The luminaire 45 is connected to the luminaire support 31 by threaded engagement between interior the neck 5 and the luminaire 45. A sealing o-ring is squeezed between the casing of the luminaire 45 and the neck 5 to seal any gaps.

The exterior diameter of the luminaire 45 and the neck portion 5 are less than diameter of the inner flange 77 and so are free to pass through the base collar 71 and past the inner flange 77.

The head portion 7 of the luminaire support 31 is sized so it is free to pass through the outer opening 71 of the base collar 71.

The outer surface 55 of the head portion 7 is sized to engage the large gripping o-ring 87 at which point a user encounters increasing resistance due to friction between the smooth outer surface 55 and the large gripping o-ring 87 but, as a result of its natural resilience, the large gripping o-ring 87 eventually deforms sufficiently to yield to head portion 5 and allow the most expanded circumference of the outer surface 55 to pass. Note that, as far as the large gripping o-ring 87 is concerned, the luminaire support 31 may be tilted.

Immediately after the most expanded circumference of the outer surface 55 has passed, the large gripping o-ring 87 returns to its original shape. As a result, the head portion 7 is gripped between the large gripping o-ring 87 and the inner flange 77. The inner flange 77 is made of substantially rigid material and does not yield to the head 7. The inner flange 77 acts as a hard stop which prevents the head portion 7 from traveling any further.

The interior of the inner flange 77 is shaped to substantially correspond to the outer surface 55 of the head portion 7. This helps to reduce friction therebetween. The small gripping o-ring 83 is an optional additional feature which also helps to reduce friction by providing an annular cushion between the outer surface 55 of the head portion 7 and the inner flange 77. Thus, in normal use, the head portion 7 is held, or squeezed, by an interference fit between the small 83 and large 87 gripping o-rings. The part spherical surface is accommodated in the annular space between the small 83 and large 87 gripping o-rings and the central channel 75. Sometimes, when the luminaire support 31 is urged in the inner direction, the head portion 7 may squeeze the small gripping o-ring 83 to the extent that the head portion 7 is held between the inner flange 77 and large gripping o-ring 87. This could occur if, for example, the light fitting was used in a side of a swimming pool with water pressure continually acting upon the luminaire support 31.

The small 83 and large 87 gripping o-rings and the locking o-ring help to prevent air drafts passing between the base 67 and the luminaire support 31 and a hole in the substrate.

The smooth outer surface 55 can slide in relation to the small 83 and large 87 gripping o-rings and, as mentioned above, the inner flange 77. This provides an adjustable coupling mechanism wherein the head portion 7 is received and retained in the base collar 67 in the manner of a ball and socket i.e. the outer surface 55 is like a ball and the small 83 and large 87 gripping o-rings and the inner flange 77 are like a socket. The luminaire support 31 and the luminaire 45 are adjustable to turn about the longitudinal axis of channel 15. At the same time, the luminaire support 31 and the luminaire 45 are adjustable to pivot its longitudinal axis in relation to the longitudinal axis of the channel 75 by an angle of up to about 20 degrees and in all directions. Thus, light projected from the luminaire 45 may be directed according to user preferences. The user may accomplish rotational and/or pivotal movement of the luminaire support 31 and the luminaire 45 in relation to the base 67 by manipulating the luminaire support 31 with a manipulating tool 71.

The luminaire support 31 and the luminaire 45 may be removed from the base 67 by pulling the luminaire support 67 outward to reverse the assembly method described above. The large gripping o-ring 87 recovers its original shape moments after the head portion 7 has passed. Thus, the light fitting is prepared for rapid re-assembly.

Whist assembly may be accomplished by the user pushing directly on the luminaire support 31 into the base 67, disassembly may be accomplished when the user manipulates the luminaire support 31 with a luminaire manipulating tool 71 as described below.

The advantage with the adjustable coupling mechanism described above is that it permits attachment, detachment and angular adjustment of the luminaire support 31 in relation to the base 67. This is achieved with a simple, efficient and durable design.

Figure 9A:
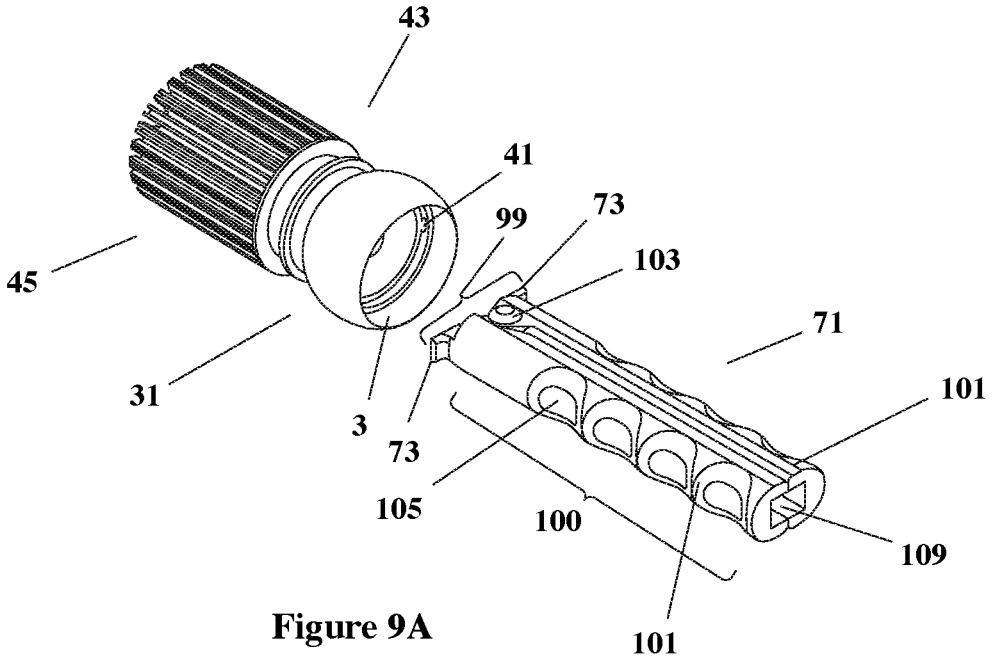
FIGS. 9A and 9B illustrate in perspective views a luminaire support tool of an aspect of the invention in an engaged and disengaged configuration.
Figure 9B:
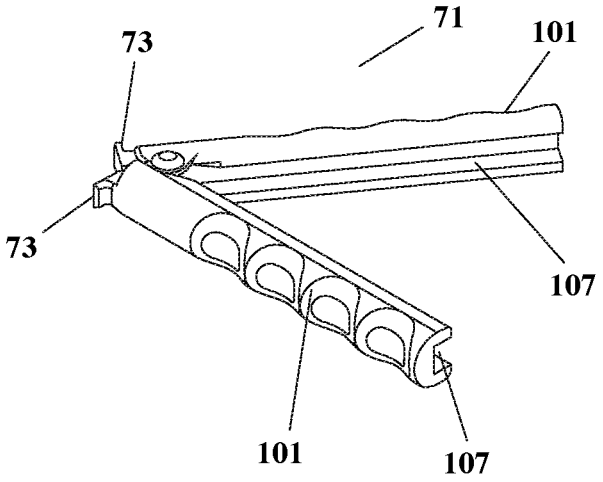
Figure 9C:
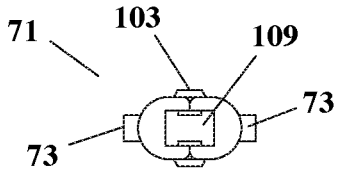
FIG. 9C illustrates and end view of the luminaire support tool of FIG. 9A in engaged configuration.

A luminaire manipulating tool 71 is illustrated in FIGS. 9A, 9B and 9C. In FIG. 9A, the tool 71 adopts an engaged configuration. In FIG. 9B, the tool 71 adopts a disengaged configuration. In FIG. 9C, the end view (from the handle end) is shown in an engaged configuration as in FIG. 9A.

Luminaire manipulating tool 71 comprises an elongate handle portion 100 and disposed at a distal end thereof and operational portion 100. Two lateral projections or flange members 73 extending in opposing lateral dimensions are disposed on the operational portion 99. The handle portion 99 comprises two opposing handles 101 hingedly mounted at a hinge 103 located proximal to the operational portion 99. Each handle 101 has a gripping outer surface 105 which is preferably shaped to ergonomically accommodate the user's fingers and has a longitudinally recessed inner surface 107. The recess 107 extends like a channel along the full length of each handle 101. Disposed on the distal end of each handle 101 is a lateral projection 73 extending laterally outward in the direction of the outer surface. The lateral projections 73 do not impede channel or recessed inner surface 107. When in a disengaged configuration, as in FIG. 9B, the handles are disposed at an angle to one another meeting at hinge 103. In the disengaged configuration, the respective lateral projections 73 extending from the distal end of each handle 101 are disposed at an angle to one another and disposed in a forward facing orientation so as to not be engageable with a corresponding aperture or recess 41 in a luminaire support 31. When in an engaged configuration, as shown in FIGS. 9A and 9C, the handles are together and the lateral projections 73 are substantially parallel and extend in generally an opposing lateral direction to one another. In this configuration, an operational portion 99 of the tool 71 disposed in a luminaire support 31 and adapted to adopt this engaged configuration, will engage with corresponding receiving apertures or recesses 41 in the inner surface thereof. A luminaire support 31 may then be manipulated by changing the angle of the luminaire support 31 in a base 67 or removing the luminaire support 31 from the base 67. Further, the insert 3 of a luminaire support 31 may be removed by unthreading (rotating the tool 71 about its longitudinal axis). When engaged and disposed in a light beam channel 15 of luminaire support 31, the two recessed inner surfaces 107 cooperate to define a tool directional channel 109 which is configured to have a longitudinal axis common or parallel with the longitudinal axis of light beam channel 15 of the luminaire support 31. Thus, when engaged to adjust the angle of the luminaire support 31 and thus the beam of light from the luminaire it supports, the beam of light may project through the tool directional channel 109 and strike a surface (e.g. in a room) thereby confirming the angle of the luminaire support 31 in the base 67. Thereby, accurate first time adjustment of angle of a luminaire in a base can be achieved and accurate pointing of a light to a subject. The profile of the tool directional channel 109 is shown as rectangular but any suitable shape can be selected by having correspondingly shaped recesses 107 in the respective handles 101.

The invention has been described with reference to a preferred embodiment. However, it will be appreciated that variations and modifications can be effected by a person of ordinary skill in the art without departing from the scope of the invention.

The invention claimed is:

1. A light fitting for recessed mounting of a luminaire in a substrate, the light fitting comprising a luminaire support, which luminaire support has a neck portion to support and configured to be removably attached to a luminaire or parts thereof and a head portion having a light beam channel for the passage of light from a luminaire through the luminaire support to a mouth, the light beam channel defined by an internal surface of the head portion, wherein the luminaire support comprises a luminaire support body and a peripheral insert removably mountable within the luminaire support body, wherein the peripheral insert defines at least a portion of the light beam channel, wherein the light fitting further comprises a lens and an optical mount for the lens, the optical mount disposed in a throat portion of the luminaire support, wherein the optical mount comprises a seat for supporting the lens and a corresponding recess for receiving the lens, wherein the lens is removably mountable in the optical mount, and wherein the peripheral insert serves to retain the lens in position in the optical mount, whereby the lens may be removed via the mouth of the luminaire support by first removing the peripheral insert from the luminaire support body, wherein the peripheral insert defines a recess or aperture for receipt of a laterally extending or extendable protrusion.

2. The light fitting as claimed in claim 1, wherein the peripheral insert is removably mountable within the luminaire support body by way of cooperating threads on an external surface of the peripheral insert and an internal surface of the luminaire support body.

3. The light fitting as claimed in claim 1, wherein the peripheral insert defines at least a portion of the internal surface of the luminaire support extending from the optical mount to the mouth.

4. The light fitting as claimed in claim 3, wherein the peripheral insert defines from 5% to 100% of the extent of the internal surface of the luminaire support from the optical mount to the mouth.

5. The light fitting as claimed in claim 4, wherein the peripheral insert defines at least 75% of the extent of the internal surface of the luminaire support from the optical mount to the mouth.

6. The light fitting as claimed in claim 1, which is configured to receive an optical accessory into the light beam channel to cooperate with the peripheral insert, wherein the optical accessory has laterally extending protrusions configured to releasably extend into the one or more recesses or apertures defined on the peripheral insert.

7. The light fitting as claimed in claim 1, which further comprises a luminaire connected to the luminaire support.

8. A light fitting system comprising:

the light fitting comprising a luminaire support as defined in claim 1 for recessed mounting of a luminaire in a substrate;

a base for receiving the luminaire support; and a luminaire support tool for manipulating the luminaire support in relation to the base of the light fitting;

wherein the luminaire support comprises a light beam channel for the passage of light from an associated luminaire, the light beam channel defining a first longitudinal axis, wherein the luminaire support tool has an elongate handle member defining a second longitudinal axis and which is adapted at a first or proximal end to engage with the luminaire support so as to facilitate its manipulation and which when engaged with the luminaire support disposes the second longitudinal axis substantially parallel with the first longitudinal axis and wherein a second or distal end of the elongate handle member has a light source configured to project a directional beam which directional beam is substantially parallel with the second longitudinal axis, whereby the directional beam projected by the light source during manipulation of the luminaire by the tool is indicative (to a user) of the angle of projection of a light beam from an associated luminaire at the adjusted position of the luminaire support;

and wherein the light source is a light directional channel disposed such that, when the luminaire support tool is engaged with the luminaire support, light from a luminaire if fitted to the luminaire support emanates or projects through the light directional channel.

9. The light fitting system as claimed in claim 8, wherein the light directional channel of the luminaire support tool is configured to be parallel, and more preferably coaxial, with the light beam channel of the luminaire support.

10. The light fitting system as claimed in claim 8, wherein the luminaire support comprises a peripheral insert and luminaire support housing, and wherein the luminaire support tool is configured for manipulating the angular orientation of the luminaire support in relation to the base, for release and recoupling of the luminaire support and the base, and for removing the peripheral insert from the luminaire support housing.

11. The light fitting system as claimed in claim 10, wherein the peripheral insert defines an engaging recess for receiving a protrusion in the luminaire support tool to enable a user to engage a tool into the recess so as to remove the insert from the luminaire support housing.

12. The light fitting as claimed in claim 1, wherein the light fitting further comprises an optical accessory that cooperates with the peripheral insert and affects the passage of light through the light beam channel, and preferably wherein the optical accessory is adapted to removably attach to the luminaire support via the mouth of the luminaire support.

13. The light fitting as claimed in claim 1, wherein the lens comprises an annular flange configured to rest on the seat and to extend into the corresponding recess.

14. The light fitting as claimed in claim 1, wherein the peripheral insert is configured to cooperate with the luminaire support body to form an edge or rim together with the luminaire support body defining a rim of the mouth.

15. The light fitting as claimed in claim 1, which further comprises a base having an outer aperture for removably receiving the luminaire support via the outer aperture.

* * * * *